United States Patent [19]

Seo et al.

[11] Patent Number: 5,076,845

[45] Date of Patent: Dec. 31, 1991

[54] PROCESS FOR PRODUCING FORMED CARBON PRODUCTS

[75] Inventors: Ikuo Seo; Yosinobu Murakami, both of Iwaki, Japan

[73] Assignee: Kureha Kagaku Kogyo Kabushiki Kaisha, Tokyo, Japan

[21] Appl. No.: 472,808

[22] Filed: Jan. 31, 1990

[30] Foreign Application Priority Data

Feb. 1, 1989 [JP] Japan ..... 1-23272

[51] Int. Cl.[5] ..... C08L 95/00

[52] U.S. Cl. ..... 106/284.4; 106/284; 106/274; 423/447.2; 423/445; 423/449; 264/29.1

[58] Field of Search ..... 106/284.4, 274, 284; 423/447.4, 447.6, 447.2, 449; 264/29.1

[56] References Cited

U.S. PATENT DOCUMENTS

| | | | |
|---|---|---|---|
| 2,527,596 | 10/1950 | Shea et al. | 106/284 |
| 3,917,806 | 11/1975 | Amagi et al. | 423/445 |
| 4,016,247 | 4/1977 | Otani et al. | 423/447.4 |
| 4,196,182 | 4/1980 | Willermet et al. | 423/449 |
| 4,534,850 | 8/1985 | Izumi et al. | 423/447.4 |
| 4,590,055 | 5/1988 | Yamada et al. | 423/447.4 |
| 4,781,908 | 11/1988 | Hara et al. | 423/447.4 |
| 4,801,372 | 1/1989 | Tate et al. | 423/447.4 |

*Primary Examiner*—William R. Dixon, Jr.
*Assistant Examiner*—Sue Hollenbeck
*Attorney, Agent, or Firm*—Oblon, Spivak, McClelland, Maier & Neustadt

[57] ABSTRACT

The present invention discloses a process for producing a formed carbon products which comprises the steps of mixing a pitch or a pitch precursor and at least one kind of polymer becoming compatible with the pitch or the pitch precursor by heat-treating and having an aromatic ring and at least one sulfur, oxygen or nitrogen atom in its repeating unit; of heat-treating the mixture to convert it to a raw material pitch and thereafter of at least forming, infusibilizing and carbonizing and which succeeded to simplify a production apparatus and to reduce an energy comsumption by reducing an infusibilizing time without deteriorating physical properties of the carbon products.

12 Claims, No Drawings

PROCESS FOR PRODUCING FORMED CARBON PRODUCTS

BACKGROUND OF THE INVENTION

The present invention relates to a process for producing a formed pitch-carbon product, more particularly to an improved infusibilizing process for producing a formed carbon product wherein a raw material pitch is prepared by mixing a pitch or a pitch precursor with a polymer and then by heat-treating the mixture.

In general, a formed carbon product is manufactured by forming a coal pitch, a petroleum pitch or a synthetic pitch and subsequently by infusibilizing and carbonizing the formed pitch product. In the manufacturing process, an infusibilizing step is so far the most time requiring step and has been a principal factor to lower the production efficiency of formed carbon products. In order to reduce the infusibilizing time, a variety of catalysts and accelerators have been investigated. For instance, in a method where a certain kind of metal salt was added to a pitch as a catalyst, although there were some salts showing recognizable effect on a reduction of an infusibilizing time, carbon products obtained have some deteriorated physical properties; and in an another method wherein the step was held in an atmosphere of halogen molecule or nitrogen oxide, which was thought to be an accelerator, although there was no carbon products having deteriorated physical properties, there was no significant reduction of time in the step. Accordingly, the methods so far investigated were unsatisfactory and it has been unavoidable to built a large scale infusibilizing apparatus because of its present ineffectiveness.

There are other infusibilizing methods, wherein pitch fibers are dusted with powdery solid lubricants such as molybdenum disulfide or talc and heat-treated thereafter and the methods are disclosed in Japanese Patent Application Laid-Open (KOKAI) Nos. 61-160,422(1986), 62-57,929(1987), 62-110,923(1987). These methods are effective in preventing fibers adhering together but almost no effect in reducing infusibilizing time.

As a result of extensive studies to develop a process for producing a carbon product, of which physical properties are not deteriorated, with a reduced infusibilizing time, the present inventors have found the fact that when a pitch or a pitch precursor (hereinafter referred to as "pitch et al.") is mixed with a polymer having no aromatic ring in each of the repeating unit, for example polyethylene; heated to make reaction with the polymer, further heated under reduced pressure to remove volatile components (hereinafter the heat-treatment to make reaction and the heat-treatment to remove volatile components are referred altogether in one word of "heat-treatment"); formed in an optional form; and infusibilized, there is no improvement of the infusibilizing time. On the other hand, the present inventors have further found the fact that when a pitch et al. is mixed with a certain polymer having an aromatic ring in each of the repeating unit, for example polyphenylene sulfide; heat-treated; formed; and infusibilized, the infusibilizing time is reduced remarkably and the carbonized products not only maintain the initial shape but also have physical properties not inferior to those of carbon products infusibilized for a long time and carbonized. Based on these findings, the present inventors have completed the present invention.

SUMMARY OF THE INVENTION

An object of the present invention is to provide a process to manufacture formed carbon products of which apparatus is quite simple and energy consumption is quite small because of reduced infusibilizing time or low infusibilizing temperature.

An another object of the present invention is to provide a process to manufacture formed carbon products which comprises mixing a pitch et al. with a polymer having an aromatic ring and at least one sulfur, oxygen or nitrogen atom in its repeating unit and becoming compatible with the pitch et al. by heat-treatment; heat-treating; forming; infusibilizing; and carbonizing.

DETAILED DESCRIPTION OF THE INVENTION

The present invention relates to a process for manufacturing a formed carbon product which comprises steps of mixing a pitch et al. with a polymer, becomes compatible therewith when the mixture is heated and has an aromatic ring and at least one sulfur, oxygen or nitrogen atom in its repeating unit, heat treating the mixture to make it into a raw material pitch and thereafter at least forming, infusibilizing and carbonizing the pitch.

Among the starting materials of the present invention, a pitch et al., a pitch precursor means a substance which becomes a pitch by heat-treatment and any of coal tar, petroleum tar or synthetic tar can be used as the precursor. However, it is preferably to select an appropriate precursor according to the shape of formed carbon product and its application. In addition, a raw material pitch of the present invention, which includes a pitch obtained by heat-treatment of said precursor with the polymer, can be an isotropic one or an anisotropic one obtained by hydrogenation or a separate heat-treatment from aforesaid heat-treatment with or without solvent-fractionation or air-blowing, etc.

To a pitch et al., a polymer, becoming compatible therewith by heat-treating and having an aromatic ring and at least one sulfur, oxygen or nitrogen atom in its repeating unit, is mixed. In the present specification, "a polymer becoming compatible with a pitch et al. by heat-treating" means a polymer which is not compatible with the pitch et al. at a relatively low temperature but becomes compatible therewith at a higher temperature. In addition, "becoming compatible" herein means a state in which any separated layer can not be recognized by eye-sight.

So far, according to a common sense in a field of the art, a use of a pitch having small H/C value, namely, a pitch being rich in aromaticity, has been believed to take a long time in infusibilization. Accordingly, it has been out of the consideration to add a substance having an aromatic ring to a pitch in order to reduce an infusibilizing time of the pitch. Contrary to the common sense, the present inventors have tried to add a polymer having an aromatic ring to a pitch et al. and reached to an unexpected results of reducing its infusibilizing time.

As for a polymer having an aromatic ring and at least one sulfur, oxygen or nitrogen atom in its repeating unit are concerned, either the polymer having aromatic rings at its main chain as exemplified by polyethylene terephthalate, polyarylene sulfide, etc. or the polymer having aromatic rings at their side chains as exemplified by polyvinyl carbazole, can be used. In particular, the polymer having at least on sulfur or nitrogen atom in its repeating unit is preferable and the polymer having a sulfur atom in its repeating unit is more preferable, for example, a polyarylene sulfide such as polyphenylene sulfide can be exemplified.

Further, as for the polymer to be added, single or mixture of the two or more can be used and an amount to be added can be optionally determined with a limit which can be compatible with a pitch et al. by heat-treating, but usually the addition amount of 0.5 to 50% by weight is preferable, 1 to 10% by weight is more preferable and 2 to 5% by weight is further preferable.

The pitch el al. mixed with the polymer are then heat treated to be converted into a raw material pitch for forming. The temperature and period of time for the heat-treatment are adjusted mainly according to the types and properties of the pitch et al. In the heat-treatment, a first step, namely, the heating reaction of the pitch et al. and the polymer is performed at a temperature higher than the temperature which is necessary to initiate the reaction, however, it is usually performed at a temperature of 350° to 450° C. and for 0.5 to 10 hours in a flow of nitrogen, and a second step for removing volatile components is performed until the pitch et al. becomes possible to be formed and infusibilized in the subsequent steps. Whether the reaction in the first step is completed or not can be judged from the aforementioned layer separation. As for the second heat-treating step, conditions to remove volatile components of the pitch el al. are determined based on the necessity to make a formed product which has enough strength to handle, not to be deformed and not to adhere to each other at an initial temperature of infusibilization. However, the second heat-treating step is usually performed at a temperature of 280° to 330° C. and for 0.5 to 3 hours.

The raw material pitch are formed, infusibilized, carbonized and graphitized, if necessary, according to conventional and publicly known methods. In the following discussion, these steps will be explained with spinning Examples. Needless to say, the Examples are also applicable to the cases where the raw material pitch is formed into an optional form, such as a film or a sphere.

The object of the infusibilizing step is to oxidize a pitch fiber to convert it into an infusibilized fiber having no thermoplasticity and to prevent the fiber from melt-deforming during the carbonization step. In the infusibilizing step, although the highest temperature for infusibilization depends on the properties of formed pitch, usually, a formed pitch is heated in an atmosphere of an oxidizing gas at a temperature raising rate of 0.5° to 2.0° C./minute up to a temperature in a range of 200° to 350° C. and kept for 0 to 60 minutes at the temperature. In the present invention, the formed pitch contains a polymer having aromatic rings, therefore, it is possible to reduce a total infusibilizing time by an increased rate of temperature raise. For example, the infusibilizing time according to the present invention can be reduced to not more than 70% of that of formed pitch containing no polymer having aromatic rings. As far as conventional pitch fibers are concerned, if their infusibilizing times are reduced, the fibers are weld together during carbonzing step, therefore, they are prone to stick together and to be deformed in their shapes.

The infusibilized fibers of the present invention can be then carbonized by heating in an inert gas, e.g., nitrogen gas, to 900° C. at a temperature raising rate of 5° to 50° C./minute to obtain carbon fibers. Further, graphite fibers can be obtained from said carbon fibers by carbonizing at the temperature not lower than 2,000° C. in an inert gas.

According to the present invention, comparing with a pitch containing no polymer having aromatic rings, it is possible to increase a temperature raising rate in the infusibilizing step while maintaining the original shape of formed pitch and to reduce remarkably the infusibilizing time. On the other hand, when a temperature raising rate is kept at the same level of the conventional step, it is possible for the raw material pitch of the present invention to have infusibilizing temperature lowered. Accordingly, the present invention permits compact infusibilizing apparatus as well as reduced energy consumption during production.

In the following examples, shape retention of the fibers are evaluated by comparing the roundness of a cross section of the pitch fiber with that of the resulting carbon fiber and the same evaluation method can be applied to other shapes. For examples, the shape retention is evaluated by comparing the roundness of pitch and carbon spheres for spherical carbons and for carbon films by comparing the surface flatness of the films.

In the following, the present invention will be explained with reference to examples, however, these examples are only illustrative and the invention is not intended to be limited to the embodiments.

EXAMPLE 1

5 parts by weight of polyphenylene sulfide was added to 100 parts by weight of ethylene tar and then after heat-treating the mixture at 400° C. for one hour in a flow of nitrogen gas, the resulting mixture was treated under a reduced pressure of 10 Torrs at 300° C. for one hour to obtain a pitch having a softening point of 180° C. and showing no separation of any layer. The pitch was spun through a single-pore nozzle with a diameter of 0.3 mm to obtain a pitch fiber having diameter of 15 μm. The fiber was infusibilized by heating starting from 100° C. to the highest temperature of 250° C. at a temperature raising rate of 6° C./minute in an atmosphere containing 1% by volume of nitrogen dioxide. The infusibilizing time was 25 minutes. Then the infusibilized fiber was heated to 900° C. for carbonization and obtained a carbon fiber. The cross section of the obtained carbon fiber was almost round and retained the shape of pitch fiber originally formed. The tensile strength and tensile elongation of the carbon fiber were 95 kg/mm$^2$ and 2.8%, respectively. In comparison with the results of COMPARATIVE EXAMPLE 1, the infusibilizing time was reduced about 75% and the properties of the carbon fiber were almost the same as in the COMPARATIVE EXAMPLE 1.

EXAMPLE 2

Ethylene tar was air blown at 180° C. and consumed about 15 l oxygen/kg tar. To 100 parts by weight of air blown ethylene tar, 5 parts by weight of polyphenylene sulfide was added and then after heat-treating the mixture at 400° C. for one hour in a flow of nitrogen, the product was treated under reduced pressure of 10 Torrs at 300° C. to obtain a pitch having a softening point of 180° C. Except for the above conditions, the same operations as in EXAMPLE 1 were performed and the infusibilizing time required for the pitch fiber was 25 minutes and the tensile strength and tensile elongation of the obtained carbon fiber were 92 kg/mm$^2$ and 2.7%, respectively.

EXAMPLE 3

Using the same pitch fiber obtained in EXAMPLE 1, except that infusibilization was performed by heating the fiber starting from 100° C. to the final temperature of 180° C. at a temperature raising rate of 1.5° C./minute, the pitch fiber was infusibilized and carbonized as in EXAMPLE 1.

Infusibilizing time was about 36 minutes. The tensile strength and the tensile elongation of the carbon fiber were 98 kg/mm$^2$ and 2.9%, respectively. In comparison with COMPARATIVE EXAMPLE 1, when the temperature raising rate in both infusibilizing processes are the same, the maximum temperature in the infusibilization of this example can be lowered and carbon fibers having similar properties can be obtained.

COMPARATIVE EXAMPLE 1

A pitch having a softening point of 180° C. was obtained from an ethylene tar. Except for adding no polymer having aromatic rings, such as, polyphenylene sulfide, the tar was spun, infusibilized and carbonized in a similar manner, namely, an infusiibilizing time of 25 minutes, as in EXAMPLE 1. Since the infusibilization was insufficient, the fibers melted together and could not be isolated to a single fiber. The conditions for infusibilizing the pitch fiber to obtain carbon fibers maintaining the cross sectional shape of pitch fibers originally formed were a temperature raising rate of 1.5° C./minute and the time for infusibilization of 100 minutes. The tensile strength and the tensile elongation were 95 kg/mm$^2$ and 2.9%, respectively.

COMPARATIVE EXAMPLE 2

5 parts by weight of polyethylene was added to 100 parts by weight of ethylene tar and after heat-treating the mixture at 400° C. for one hour in a flow of nitrogen gas, the mixture was treated under a reduced pressure to obtain a pitch having a softening point of 181° C. The pitch was spun in a similar manner as in EXAMPLE 1 to obtain pitch fiber having a diameter of 15 μm. The pitch fiber was infusibilized and carbonized in a similar manner as in EXAMPLE 1, however, the fibers melted together and could not be isolated in a single fiber.

The conditions for infusibilizing the pitch fiber to obtain carbon fiber maintaining the cross sectional shape of pitch fiber originally formed were a temperature raising rate of 1.5° C./minute and the time for infusibilization of 100 minutes. The tensile strength and the tensile elongation of the obtained carbon fiber were 87 kg/mm$^2$ and 2.6%, respectively.

What is claimed is:

1. A process for producing a formed carbon product, comprising the steps of:

mixing a pitch or a pitch precursor and at least one kind of polymer which becomes compatible with the pitch or the pitch precursor at the temperature employed in subsequent heat treatment of the pitch or pitch precursor and which has an aromatic ring and at least one sulfur, oxygen or nitrogen atom in its repeating units;

heat treating the mixture thereby preparing a raw material pitch; and thereafter at least forming, infusibilizing and carbonizing the raw material pitch.

2. The process according to claim 1 wherein an amount of said polymer mixed is 0.5 to 50% by weight based on the mixture.

3. The process according to claim 1 wherein said polymer has at least one sulfur or nitrogen atom in its repeating unit.

4. The process according to claim 1 wherein said polymer has at least one sulfur atom in its repeating unit.

5. The process according to claim 4, wherein said polymer is a polyarylene sulfide.

6. The process according to claim 5, wherein said polyarylene sulfide is polyphenylene sulfide.

7. The process according to claim 1, wherein the rate of temperature increase in the infusibilizing step is at least 1.4 times the infusibilizing rate of a polymer free pitch or a pitch precursor.

8. The process according to claim 2, wherein the amount of said polymer ranges from 1 to 10% by weight.

9. The process according to claim 8, wherein said heat treatment occurs in one step and optionally a second step, said first step occurring at a temperature of 350° to 450° C. for 0.5 to 10 hours, and the optional second step occurring at a temperature of 280° to 330° C. for 0.5 to 3 hours.

10. The process according to claim 8, wherein said step of infusibilization occurs in an oxidizing atmosphere at a rate of temperature increase of 0.5° to 2.0° C./ minute up to a temperature in the range of 200°-350° C. which is maintained for 0 to 60 minutes.

11. The process according to claim 8, wherein said carbonizing occurs by heating the infusibilized material under an inert gas to 900° C. at a rate of temperature increase of 5° to 50° C./minute.

12. A process for producing a formed carbon product, consisting essentially of the steps of:

mixing a pitch or a pitch precursor and at least one kind of polymer which becomes compatible with the pitch or the pitch precursor at the temperature employed in subsequent heat treatment of the pitch or pitch precursor and which has an aromatic ring and at least one sulfur, oxygen or nitrogen atom in its repeating units;

heat treating the mixture thereby preparing a raw material pitch; and thereafter at least forming, infusibilizing and carbonizing the raw material pitch.

* * * * *